US010676802B2

(12) United States Patent
Ryu

(10) Patent No.: US 10,676,802 B2
(45) Date of Patent: Jun. 9, 2020

(54) FORGING METHOD

(71) Applicant: Pusan National University Industry-University Cooperation Foundation, Busan (KR)

(72) Inventor: Kwang Ryel Ryu, Busan (KR)

(73) Assignee: PUSAN NATIONAL UNIVERSITY INDUSTRY-UNIVERSITY COOPERATION FOUNDATION, Busan (KR)

( * ) Notice: Subject to any disclaimer, the term of this patent is extended or adjusted under 35 U.S.C. 154(b) by 0 days.

(21) Appl. No.: 16/228,383

(22) Filed: Dec. 20, 2018

(65) Prior Publication Data

US 2019/0185960 A1 Jun. 20, 2019

(30) Foreign Application Priority Data

Dec. 20, 2017 (KR) ..... 10-2017-0176054

(51) Int. Cl.

| | |
|---|---|
| ***G06F 19/00*** | (2018.01) |
| ***C21D 11/00*** | (2006.01) |
| ***C21D 9/00*** | (2006.01) |
| ***B21J 1/00*** | (2006.01) |
| ***B21J 5/06*** | (2006.01) |

(52) U.S. Cl.

CPC ..... *C21D 11/00* (2013.01); *B21J 1/00* (2013.01); *B21J 5/06* (2013.01); *C21D 9/0068* (2013.01)

(58) Field of Classification Search

CPC ..... B21J 5/06; B21J 1/00; B21J 1/003; B21J 1/06; C21D 11/00; C21D 9/0068

See application file for complete search history.

(56) References Cited

U.S. PATENT DOCUMENTS

| | | | | |
|---|---|---|---|---|
| 4,117,293 | A * | 9/1978 | Wicker | B21J 1/06 219/646 |
| 2003/0056361 | A1* | 3/2003 | Matsumoto | B21J 5/00 29/527.5 |
| 2007/0116591 | A1* | 5/2007 | Sharpe | C21D 7/13 419/28 |

FOREIGN PATENT DOCUMENTS

| | | | |
|---|---|---|---|
| JP | 07-290125 | A | 11/1995 |
| KR | 10-0736804 | B1 | 7/2007 |
| KR | 10-1125812 | B1 | 3/2012 |
| KR | 10-1550667 | B1 | 9/2015 |
| KR | 10-1868501 | B1 | 6/2018 |

* cited by examiner

*Primary Examiner* — Zhipeng Wang

(74) *Attorney, Agent, or Firm* — Alston & Bird LLP

(57) ABSTRACT

A forging method is provided. The forging comprises determining plans of second and third processes for each of a plurality of ingots, categorizing the plurality of ingots into first and second ingot sets, based on the plans of the second and third processes, evaluating the first and second ingot sets using a scoring function, determining an ingot set to be provided to a first heating furnace, based on the evaluating of the first and second ingot sets, and performing a first process, different from the second and third processes, on the ingot set provided to the first heating furnace.

7 Claims, 5 Drawing Sheets

FORGING METHOD

CROSS REFERENCE TO RELATED APPLICATIONS

The present application claims priority from Korean Patent Application No. 10-2017-0176054, filed on Dec. 20, 2017 in the Korean Intellectual Property Office, the content of which is incorporated herein by reference in its entirety

FIELD OF THE INVENTION

The present disclosure relates to a forging method and, more particularly, to a method of assigning ingots to heating furnaces in a heating process for forging.

BACKGROUND OF THE INVENTION

Hot free forging is a method of producing a product by applying a pressure to an ingot heated to a high temperature to transform the ingot in various forms. Hot free forging may typically include a heating process, a forging process, a cutting process, and a heat treatment process.

In the case of inputting an ingot to a heating furnace to perform the heating process, a plurality of ingots may be simultaneously input to the heating furnace. The ingots simultaneously input to the heating furnace may be simultaneously output. In other words, the plurality of ingots input to the heating furnace cannot be removed from the heating furnace unless the entire heating process is completed.

An extended period of time may be consumed in performing the heating process, since an ingot having a large weight may be heated in the heating process. When the time for which the heating process is performed is extended, a greater amount of gas may be consumed, thereby increasing manufacturing costs. In addition, the amount of energy and the period of time consumed in the heating process may vary, depending on the composition of the plurality of ingots simultaneously input to the heating furnace.

Therefore, it is necessary to effectively categorize ingots to reduce the manufacturing costs of free forging.

BRIEF SUMMARY OF THE INVENTION

Aspects of the present disclosure provide a forging method reducing manufacturing costs.

Aspect of the present disclosure provide a forging method managing schedules efficiently.

It should be noted that objects of the present disclosure are not limited to the above-described objects, and other objects of the present disclosure will be apparent to those skilled in the art from the following descriptions.

The forging method according to embodiments of the present disclosure can evaluate ingot sets, based on a scoring function having an amount of used energy as an objective function, and assign an ingot set having a high evaluation score to a heating furnace, thereby reducing manufacturing costs.

In addition, the forging method according to embodiments of the present disclosure can evaluate ingot sets, based on a scoring function having a process execution time as an objective function, and assign an ingot set having a high evaluation score to a heating furnace, thereby efficiently managing schedules.

It should be noted that effects of the present disclosure are not limited to the above descriptions, and more various effects are included herein.

BRIEF DESCRIPTION OF THE DRAWINGS

The above and other aspects and features of the present disclosure will become more apparent by describing in detail exemplary embodiments thereof with reference to the attached drawings, in which.

DETAILED DESCRIPTION OF THE INVENTION

Figure 1:
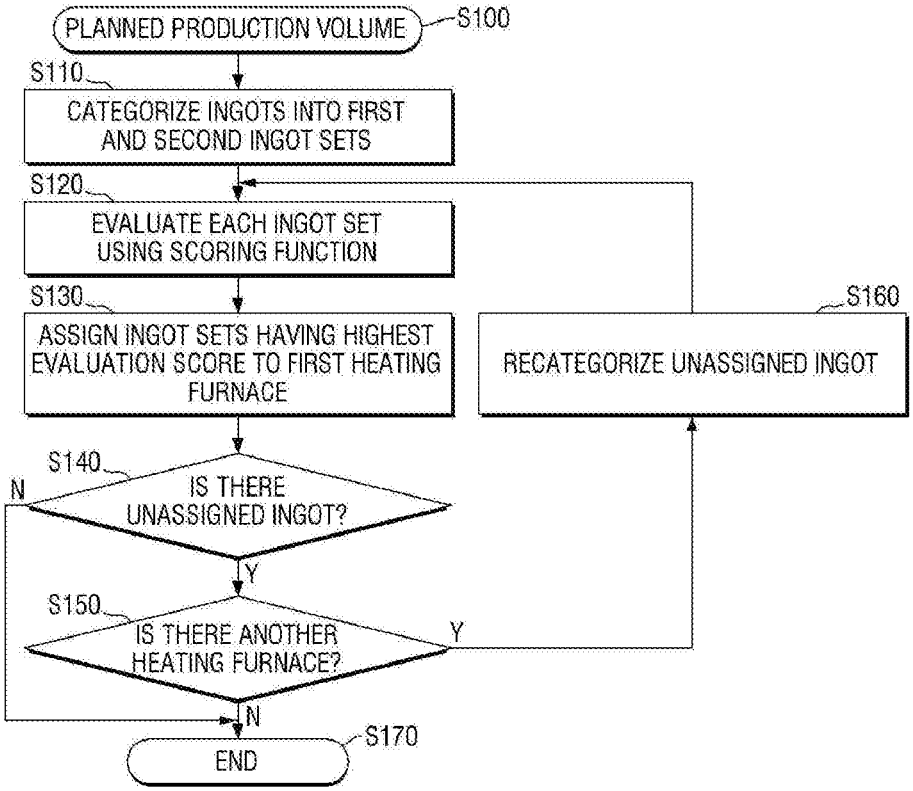
FIG. 1 is an exemplary flowchart illustrating a method of assigning ingots to heating furnaces according to some exemplary embodiments.

Advantages and features of the present disclosure and methods of accomplishing the same may be understood more readily by reference to the following detailed description of exemplary embodiments and the accompanying drawings. The present disclosure may, however, be embodied in many different forms and should not be construed as being limited to the embodiments set forth herein. Rather, these embodiments are provided so that this disclosure will be thorough and complete and will fully convey the concept of the invention to those skilled in the art, and the present disclosure will only be defined by the appended claims. Like reference numerals refer to like elements throughout the specification.

It will be understood that, although the terms first, second, third, etc., may be used herein to describe various elements, components, and/or sections, these elements, components, and/or sections should not be limited by these terms. These terms are only used to distinguish one element, component, or section from another element, component, or section. Thus, a first element, component, or section discussed below could be termed a second element, component, or section without departing from the teachings of the present disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present.

Spatially relative terms, such as "below," "beneath," "lower," "above," and "upper", may be used herein for ease of description to describe the relationship of one element or component to another element(s) or component(s) as illustrated in the figures. It will be understood that the spatially relative terms are intended to encompass different orientations of the device in use or operation, in addition to the orientation depicted in the figures. For example, if the device in the figures is turned over, elements described as "below" or "beneath" other elements or features would then be oriented "above" the other elements or features. Thus, the exemplary term "below" or "beneath" can encompass both an orientation of above and below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated components, steps, operations, and/or elements, but do not preclude the presence or addition of one or more other components, steps, operations, elements, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is an exemplary flowchart illustrating a method of assigning ingots to heating furnaces according to some exemplary embodiments.

First, a planned production volume may be provided (S100). The planned production volume may include types of products to be produced, types of ingots to be used, the number of products to be produced, a production deadline, and the like.

Ingots to be used may be categorized into a plurality of ingot sets (S110). For example, ingots to be input to the heating furnace may be categorized into a first ingot set and a second ingot set. After the ingots are input to the heating furnace, a heating process may be performed.

The ingots to be input to the heating furnace may be categorized based on a variety of criteria. In some exemplary embodiments, ingots having the same or similar mass may be categorized as a single ingot set. In other embodiments, ingots to be manufactured into the same or similar products may be categorized as a single ingot set.

In still other embodiments, ingots to be input to the heating furnace may be categorized based on processing plans thereof subsequent to the heating process. For a detailed description thereof, FIG. 2 will be referred to.

Figure 2:
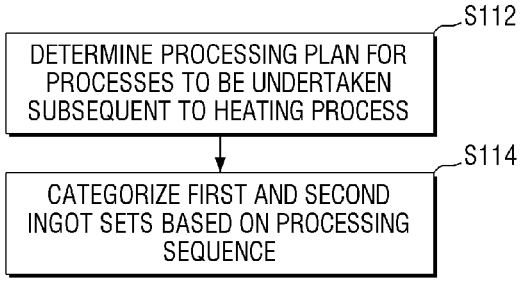
FIG. 2 is an exemplary diagram illustrating a method of categorizing ingots based on processing plans thereof subsequent to the heating process according to some exemplary embodiments.

FIG. 2 is an exemplary diagram illustrating a method of categorizing ingots based on processing plans thereof subsequent to the heating process according to some exemplary embodiments.

Referring to FIG. 2, processing plans regarding processes to be undertaken subsequent to the heating process are determined (S112). Processes to be undertaken subsequent to the heating process may include a cutting process, a heat treatment process, and a forging process. In some exemplary embodiments, the cutting process may be performed using a cutting machine, the heat treatment process may be performed using a heat treatment furnace, and the forging process may be performed using a pressing machine.

Afterwards, the ingots may be categorized into a plurality of ingot sets, based on the processing plans regarding the processes to be undertaken subsequent to the heating process. For example, the ingots may be categorized into a first ingot set and a second ingot set, based on the processing plans regarding the processes to be undertaken subsequent to the heating process. For an illustrative description, FIG. 3 will be referred to.

Figure 3:
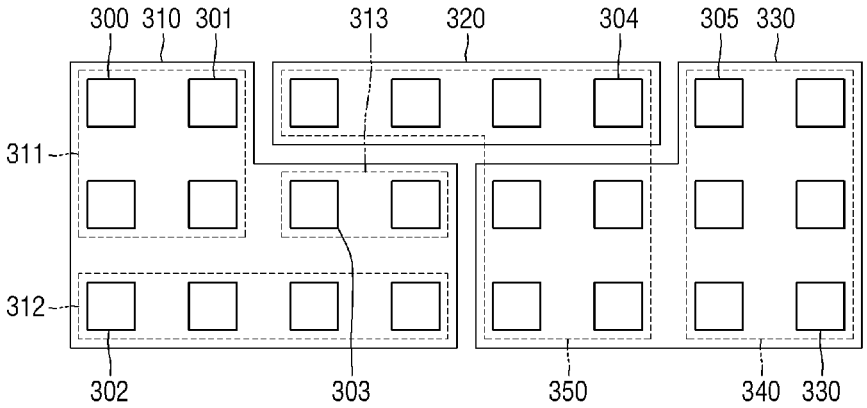
FIG. 3 is an exemplary diagram illustrating a process of categorizing ingots into a plurality of ingot sets, according to some exemplary embodiments.

FIG. 3 is an exemplary diagram illustrating a process of categorizing ingots into a plurality of ingot sets, according to some exemplary embodiments.

Referring to FIGS. 2 and 3, FIG. 3 illustrates a plurality of ingots to be input to a heating furnace. First to sixth ingots 300 to 305 will be described, for the sake of brevity. On the assumption that the heating process for all of the first to sixth ingots 300 to 305 has been completed, processing plans regarding processes to be undertaken subsequent thereto may be determined.

In some exemplary embodiments, ingots to be subjected to the same process subsequent to the heating process may be categorized as a single ingot set. For example, the first to fourth ingots 300 to 303 may be subjected to a cutting process subsequent to the heating process. In other words, the first to fourth ingots 300 to 303 may be subjected to the same process directly subsequent to the heating process. Thus, the first to fourth ingots 300 to 303 may belong to a single ingot set, i.e. a first ingot set 310. In addition, for example, the fifth ingot 304 may be subjected to a heat treatment process subsequent to the heating process. Thus, the fifth ingot 304 may belong to a second ingot set 320. Furthermore, for example, the sixth ingot 305 may be subjected to a forging process subsequent to the heating process. Thus, the sixth ingot 305 may belong to a third ingot set 330.

In some exemplary embodiments, ingots to be subjected to the same process subsequent to the heating process may be categorized into ingot sets depending on priorities. For example, among the first to fourth ingots 300 to 303 subjected to the cutting process subsequent to the heating process, the first and second ingots 300 and 301 having relatively-short deadlines may be categorized as a fourth ingot set 311. In addition, the third ingot 302 having a longer deadline, among the first to fourth ingots 300 to 303 subjected to the cutting process subsequent to the heating process, may be categorized as a fifth ingot set 312. In addition, the fourth ingot 303 having a deadline longer than those of the first and second ingots 300 and 301 and shorter than that of the third ingot 302, among the first to fourth ingots 300 to 303 subjected to the cutting process subsequent to the heating process, may be categorized as a sixth ingot set 313.

Although the method of categorizing the ingots into ingot sets, based on the processing plans to be undertaken subsequent to the heating process, has been described with reference to FIGS. 2 and 3, exemplary embodiments are not limited thereto. Those skilled in the art to which the present disclosure relates may heuristically categorize the ingots into a plurality of ingot sets, based on a variety of methods. For example, the ingots may be categorized into the first to third ingot sets 310, 320, and 330, based on the mass of the ingots. In addition, for example, the ingots may be categorized into the first to third ingot sets 310, 320, and 330, based on products to be produced. Furthermore, for example, the ingots may be categorized into the first, second, and third sets ingot sets 310, 320, and 330, in the order of the shorter deadlines, regardless of the processing plans to be undertaken subsequent to the heating process.

Referring again to FIGS. 1 and 3, each of the plurality of ingots may be evaluated using a scoring function (S120).

In some exemplary embodiments, the ingots to be input to the heating furnace may be categorized into the first to third ingot sets 310, 320, and 330. Evaluation scores for the first to third ingot sets 310, 320, and 330 may be obtained using the scoring function.

In some exemplary embodiments, the scoring function may include first to third scoring functions. For example, an objective function of the first scoring function may be set to minimize the amount of used energy. For example, an objective function of the second scoring function may be set to minimize process execution time. For example, an objective function of the third scoring function may be set to optimize the amount of used energy and the process execution time. A variety of other scoring functions than the first to third scoring functions may be implemented. A user may implement a new scoring function by devising a scoring function as required and repeatedly updating weights.

In some exemplary embodiments, the amount of used energy and the heating execution time of the heating furnace may be in a trade-off relationship. For example, when the first to third ingot sets 310, 320, and 330 are evaluated based on the first scoring function, an ingot set in which the amount of energy used by the heating furnace is minimized may be assigned, but the execution time of the heating process may be extended. For example, when the first to third ingot sets 310, 320, and 330 are evaluated based on the second scoring function, an ingot set in which the execution time of the heating process is minimized may be assigned, but the amount of energy used by the heating furnace may be increased. Accordingly, a user may assign an ingot set most suitable for the current situation to the heating furnace, using a variety of scoring functions as required.

The scoring function may be expressed by following Equation (1).

$$s(j) = \sum_i w_i C_i(j) \qquad \text{Equation(1)}$$

In Equation (1), s(j) indicates a scoring function, j indicates an ingot set, $C_i(j)$ indicates an ith variable for a jth ingot set, $C_i$ indicates an ith variable, and $w_i$ indicates a weight for the ith variable.

In some exemplary embodiments, Ci may include a gross mass ratio of an ingot included in an ingot set with respect to the capacity of the heating furnace, a variance in the mass distribution of the ingot included in the ingot set, the number of types of products produced from the ingot included in the ingot set, and an estimated consumption time when the ingot set is input to the heating furnace.

$w_i$ is a weight for an $i^{th}$ variable, which may be determined by an optimization algorithm and may be repeatedly updated. A method of determining a weight will be described with reference to FIG. 4.

Figure 4:
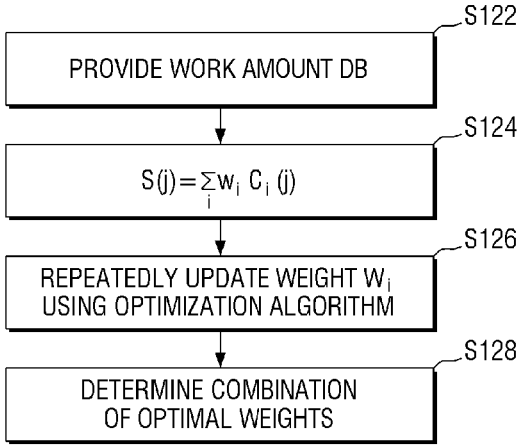
FIG. 4 is an exemplary flowchart illustrating a method of determining a weight of a scoring function according to some exemplary embodiments.

FIG. 4 is an exemplary flowchart illustrating a method of determining a weight of a scoring function according to some exemplary embodiments.

A database for an amount of work may be provided (S122). In some exemplary embodiments, the work amount database may include variable information and objective function information. For example, the variable information may include a gross mass ratio of an ingot included in an ingot set with respect to the capacity of the heating furnace, a variance in the mass distribution of the ingot included in the ingot set, the number of types of products produced from the ingot included in the ingot set, and a consumption time when the ingot set is input to the heating furnace. In addition, the objective function information may include an amount of used energy and a total consumption time according to the corresponding variable information.

The scoring function expressed by Equation (1) may be calculated using the work amount database (S124).

In some exemplary embodiments, it is possible to determine the relationship between the variable information and the objective function information, i.e. a value of an optimized weight for each piece of the variable information, using the optimization algorithm. Afterwards, when a new database is input, weights may be updated again by the optimization algorithm (S126). For example, the optimization algorithm may be a genetic algorithm.

A combination of optimal weights may be determined using the optimization algorithm (S128).

Although the optimization algorithm has been described above as being used as a method of determining weights with reference to FIG. 4, exemplary embodiments are not limited thereto. In other exemplary embodiments, the relationship between the variable information and the objective function information, i.e. a value of a weight for each piece of the variable information, may be determined by regression analysis. For example, the regression analysis may be performed using a neural network.

In some exemplary embodiments, weights may be repeatedly updated. Thus, the greater the capacity of the work amount database is, the higher the accuracy and reliability of determined weights may be.

Referring again to FIGS. 1 and 3, an ingot set having a highest evaluation score may be assigned to a first heating furnace (S130).

In some exemplary embodiments, a first evaluation score for the first ingot set 310, a second evaluation score for the second ingot set 320, and a third evaluation score for the third ingot set 330 may be compared. When the first evaluation score is higher than either the second or third evaluation score, the first ingot set 310 may be assigned to the first heating furnace.

It may be determined as to whether or not an unassigned ingot set is present (S140).

When there is no other unassigned ingot set, i.e. all ingots are respectively assigned to a heating furnace, the method of assigning ingots to heating furnaces may be terminated (S170).

When there is an unassigned ingot set, it may be determined as to whether or not another operable heating furnace is present (S150).

When there is no other operable heating furnace, the method of assigning ingots to heating furnaces may be terminated (S170).

When there is another operable heating furnace, ingots belonging to an unassigned ingot set may be recategorized (S160).

A case in which the first ingot set 310 is assigned to a first heating furnace and a second heating furnace is operable will be described by way of example. Referring to FIGS. 1 and 3, recategorization may be performed on the second and third ingot sets 320 and 330. In other words, all of the ingots belonging to the second and third ingot sets 320 and 330 may be recategorized as other ingot sets. In some exemplary embodiments, all of the ingots belonging to the second and third ingot sets 320 and 330 may be recategorized into fourth and fifth ingot sets 340 and 350, depending on specific criteria of categorization. In this case, the criteria of recategorization for ingot sets may be the same as or different from the above-described criteria of categorization.

Subsequently, the process of reevaluating each of the recategorized ingot sets using the scoring function may be repeated (S120). The process of assigning ingots to heating furnaces according to some exemplary embodiments will be sequentially described with reference to FIG. 5.

Figure 5:
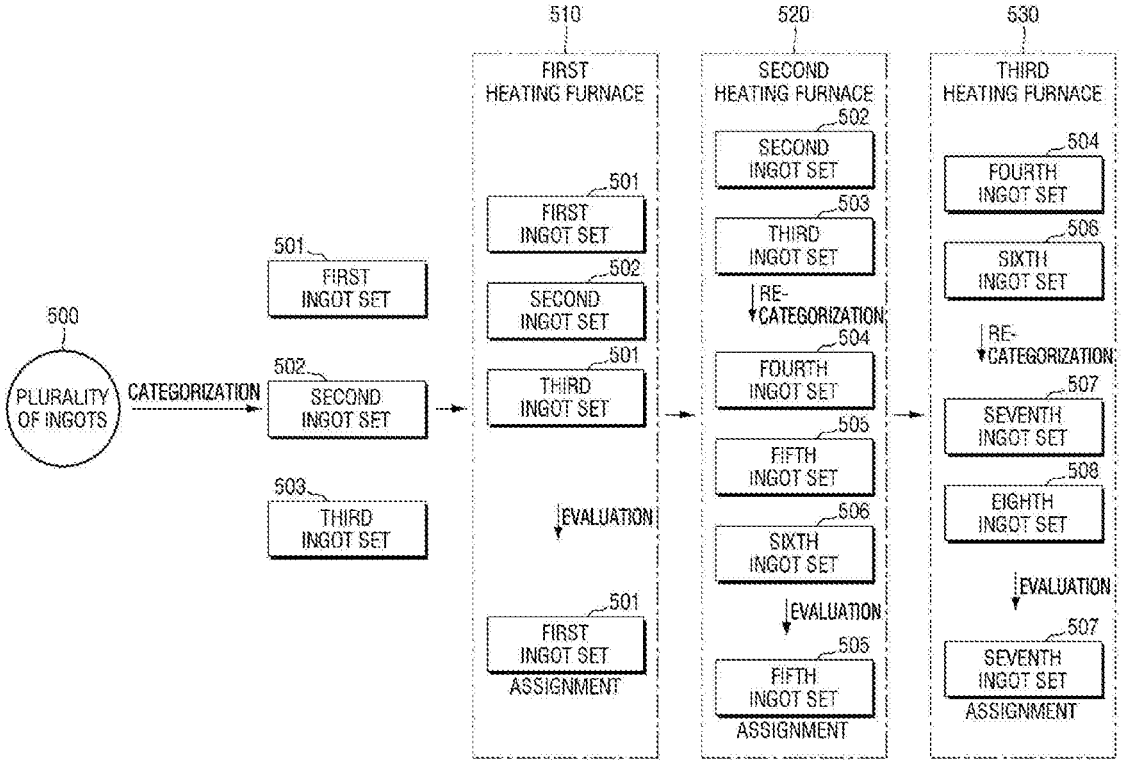
FIG. 5 is an exemplary diagram illustrating the process of assigning ingots to heating furnaces according to some exemplary embodiments in a time sequential manner.

FIG. 5 is an exemplary diagram illustrating the process of assigning ingots to heating furnaces according to some exemplary embodiments in a time sequential manner.

Referring to FIG. 5, a plurality of ingots 500 according to some exemplary embodiments may be categorized into first to third ingot sets 501 to 503. Although the plurality of ingots 500 may be categorized into the first to third ingot sets 501 to 503, based on processing plans thereof subsequent to the heating process, the present disclosure is not limited thereto.

An ingot set to be assigned to a first heating furnace 510 may be determined. In some exemplary embodiments, evaluation scores of the first to third ingot sets 501 to 503 may be calculated using a scoring function. The scoring function used for the first heating furnace 510 may be, for example, the first scoring function set to minimize the amount of used energy. However, exemplary embodiments are not limited thereto. For example, the scoring function used for the first heating furnace 510 may be the second and third scoring functions. The first ingot set 501 may be assigned as the ingot set to be input to the first heating furnace 510.

When a second heating furnace 520 is operable, a plurality of ingots belonging to the second and third ingot sets 502 and 503 may be recategorized into fourth to sixth ingot sets 504 to 506.

An ingot set to be assigned to the second heating furnace 520 may be determined. In some exemplary embodiments, evaluation scores of the fourth to sixth ingot sets 504 to 506 may be calculated using a scoring function. The scoring function used for the second heating furnace may be the second scoring function set to minimize the process execution time. However, exemplary embodiments are not limited thereto. For example, the scoring function used for the second heating furnace 520 may be the first and third scoring functions. The fifth ingot set 505 may be assigned as the ingot set to be input to the second heating furnace 520.

Subsequently, when a third heating furnace 530 is operable, a plurality of ingots belonging to the fourth and sixth ingot sets 504 and 506 may be recategorized into seventh and eighth ingot sets 507 and 508.

Ingot sets to be assigned to the third heating furnace 530 may be determined. In some exemplary embodiments, evaluation scores of the seventh and eighth ingot sets 507 and 508 may be calculated using a scoring function. The scoring function used for the third heating furnace 530 may be the third scoring function set to optimize the process execution time and energy consumption. However, exemplary embodiments are not limited thereto. For example, the scoring function used for the third heating furnace 530 may be the second and third scoring functions. The seventh ingot set 507 may be assigned as the ingot set to be input to the third heating furnace 530. Since there is no other operable heating furnace for the eighth ingot set 508, the method of assigning ingots to heating furnaces may be terminated.

Although the fourth and sixth ingot sets 504 and 506 have been described as being categorized into the seventh and eighth ingot sets 507 and 508 in some exemplary embodiments, the present disclosure is not limited thereto. In some exemplary embodiments, when there is no other operable heating furnace, both the fourth and sixth ingot sets 504 and 506 may be assigned to the third heating furnace 530.

When the method of assigning ingots to heating furnaces according to some exemplary embodiments is used, it is possible to adjust the amount of used energy as required by the user. In addition, when the method of assigning ingots to heating furnaces according to some exemplary embodiments is used, it is possible to adjust the process execution time as required by the user. Accordingly, when the method of assigning ingots to heating furnaces according to some exemplary embodiments is properly used, it is possible to properly adjust a period of time used for forging while reducing manufacturing costs consumed for forging.

While the embodiments of the present disclosure have been described with reference to experimental examples and the accompanying drawings, it will be understood by those of ordinary skill in the art that various changes in form and detail may be made therein without departing from the spirit and scope of the present disclosure as defined by the following claims. The embodiments should be considered in a descriptive sense only and not for purposes of limitation.

What is claimed is:

1. A forging method comprising:

determining plans of second and third processes for each of a plurality of ingots;

categorizing the plurality of ingots into first and second ingot sets, based on the plans of the second and third processes;

evaluating the first and second ingot sets using a scoring function;

determining an ingot set to be provided to a first heating furnace, based on the evaluating of the first and second ingot sets; and performing a first process, different from the second and third processes, on the ingot set provided to the first heating furnace.

2. The forging method of claim 1, wherein the first process comprises a heating process, the second process comprises one selected from among a forging process, a cutting process, and a heat treatment process, and the third process comprises one selected from among a forging process, a cutting process, and a heat treatment process, different from the second process.

3. The forging method of claim 1, wherein the scoring function comprises products of first variables for the first and second ingot sets and a first weight for the first variables.

4. The forging method of claim 3, wherein the evaluating of the first and second ingot sets comprises comparing the product of the first variable of the first ingot set and the first weight with the product of the first variable of the second ingot set and the first weight.

5. The forging method of claim 3, wherein the first variables include a mass, a variance in mass distribution, a number of types of products manufactured, and an estimated consumption time.

6. The forging method of claim 3, wherein the first weight is repeatedly updated by a generic algorithm.

7. A forging method comprising:

categorizing a plurality of ingots into first and second ingot sets;

evaluating the first and second ingot sets using a scoring function;

determining an ingot set to be provided to a first heating furnace, based on the evaluation on the first and second ingot sets; and performing a first process on the ingot set provided to the first heating furnace, wherein, when the ingot set to be provided to the first heating furnace is determined to be the first ingot set, the second ingot set is recategorized into third and fourth ingot sets, the third and fourth ingot sets are evaluated using the scoring function, and an ingot set to be provided to a second heating furnace is determined, based on the evaluation on the third and fourth ingot sets, and when the ingot set to be provided to the first heating furnace is determined to be the second ingot set, the first ingot set is recategorized into third and fourth ingot sets, the third and fourth ingot sets are evaluated using the scoring function, and an ingot set to be provided to the second heating furnace is determined, based on the evaluation on the third and fourth ingot sets.

* * * * *